US009119436B1

(12) United States Patent
Ardell et al.

(10) Patent No.: US 9,119,436 B1
(45) Date of Patent: Sep. 1, 2015

(54) FAST TRANSITION RUNNING SHOE

(71) Applicants: Donald B Ardell, St. Petersburg, FL (US); Raphael V Lupo, McLean, VA (US)

(72) Inventors: Donald B Ardell, St. Petersburg, FL (US); Raphael V Lupo, McLean, VA (US)

( * ) Notice: Subject to any disclaimer, the term of this patent is extended or adjusted under 35 U.S.C. 154(b) by 0 days.

(21) Appl. No.: 14/174,969

(22) Filed: Feb. 7, 2014

(51) Int. Cl.

| | |
|---|---|
| ***A43B 1/08*** | (2006.01) |
| ***A43B 5/06*** | (2006.01) |
| ***A43B 1/10*** | (2006.01) |
| ***A43B 1/14*** | (2006.01) |
| ***A43C 15/02*** | (2006.01) |
| ***A43B 21/36*** | (2006.01) |

(52) U.S. Cl.
CPC ... *A43B 5/06* (2013.01); *A43B 1/08* (2013.01); *A43B 1/10* (2013.01); *A43B 1/14* (2013.01); *A43B 21/36* (2013.01); *A43C 15/02* (2013.01)

(58) Field of Classification Search
CPC ..... A43B 11/00; A43B 5/185; A43B 3/0036; A43B 3/06; A43B 3/24; A43C 11/004; A43C 19/00
USPC ..... 36/105, 138
See application file for complete search history.

(56) References Cited

U.S. PATENT DOCUMENTS

| | | | | |
|---|---|---|---|---|
| 3,075,307 | A * | 1/1963 | Becker | 36/7.7 |
| 3,192,651 | A * | 7/1965 | Smith | 36/105 |
| 4,136,468 | A * | 1/1979 | Munschy | 36/97 |
| 4,719,709 | A | 1/1988 | Vaccari | |
| 5,079,858 | A | 1/1992 | Sartor et al. | |
| 5,184,410 | A * | 2/1993 | Hamilton | 36/105 |
| 5,222,313 | A | 6/1993 | Dowdy et al. | |
| 5,282,327 | A | 2/1994 | Ogle | |
| 5,481,814 | A * | 1/1996 | Spencer | 36/138 |
| 5,826,355 | A | 10/1998 | Vaccari | |
| 7,059,069 | B2 | 6/2006 | Raluy et al. | |
| 7,225,563 | B2 | 6/2007 | Chen et al. | |
| 7,607,242 | B2 * | 10/2009 | Karandonis et al. | 36/105 |
| 7,685,747 | B1 | 3/2010 | Gasparovic et al. | |
| 7,793,438 | B1 | 9/2010 | Busse et al. | |
| 8,006,410 | B2 | 8/2011 | Romboli et al. | |
| 8,065,819 | B2 | 11/2011 | Kaufman | |
| 8,161,669 | B2 * | 4/2012 | Keating | 36/112 |
| 8,209,886 | B2 | 7/2012 | Hurd et al. | |
| 8,272,148 | B2 | 9/2012 | Nishiwaki et al. | |
| 8,302,329 | B2 | 11/2012 | Hurd et al. | |
| 8,499,474 | B2 | 8/2013 | Kaufman | |
| 8,539,695 | B1 * | 9/2013 | Gemmen | 36/11.5 |
| 2003/0200680 | A1 * | 10/2003 | Chang | 36/69 |
| 2008/0066344 | A1 | 3/2008 | Kelley | |
| 2010/0251572 | A1 * | 10/2010 | Baudouin et al. | 36/103 |
| 2011/0247238 | A1 * | 10/2011 | Chestnut | 36/105 |
| 2012/0023783 | A1 | 2/2012 | Nichols | |
| 2012/0079746 | A1 * | 4/2012 | Ferreira et al. | 36/105 |
| 2014/0360049 | A1 * | 12/2014 | Panian et al. | 36/83 |

FOREIGN PATENT DOCUMENTS

| | | | |
|---|---|---|---|
| WO | 2010/048203 | A1 | 4/2010 |

* cited by examiner

*Primary Examiner* — Kristen Matter

(57) ABSTRACT

A running shoe design focused on the heel section of running shoes used in, for example, T2 transition phase of the sport of triathlon. The heel reclines to facilitate the insertion of the foot without use of hands or need to bend in any way. Straps partially on the heel sides, kept at bay from premature contact with attachment pads on the forward portion of the running shoe, are kept away, and may also be kept later from premature contact by wire guides. Upon foot insertion, these straps, one on each side of the foot, are guided and securely affixed into place, for example, by a pressure movement of the opposite foot of the athlete.

12 Claims, 8 Drawing Sheets

FAST TRANSITION RUNNING SHOE

BACKGROUND OF THE INVENTION

In conventional triathlon competition, there are three race segments—swim/bike/run, over which the total race time is measured. There are also two transition phases between the three race segments. There is a first transition stage "T1" between the initial leg of a triathlon, namely, the swim and the second event segment, the bike. The bike segment is followed by a second transition stage, called "T2." This is the zone between the bike and the run segments. Thus, the total amount of time the athlete spends in each of the three racing segments, plus the two transition stages, all add up to determine the athlete's race time.

In other words, seconds spent in the transition areas are every bit as precious to the competitor as the time required to complete the swim, bike and run segments of the race. The time spent in T2 managing the complexities of returning the bike to its assigned rack, removing the helmet from the head and placing it on the bike (or ground), dealing with running shoes and, for many competitors, arranging a variety of optional items (sun block, race belt, nutritional aids, hat, etc.) will all add up and affect the outcome of the race for all participants. As such, it is an objective to minimize the time spent in such transitions, especially the T2 transition.

Unless and until the triathlete has practiced and become adept in managing the two transition segments, substantial time will be lost in T1 and T2. These two transition segments are fraught with difficulties. The difficulties include the extraordinary pressure most athletes feel to enter and exit the transition areas as quickly as possible. However, the body is under great stress after a swim due to cardio-vascular fatigue from the time spent swimming and then having to adapt to a run, often a considerable distance, to the T1 area—barefooted over what are sometimes slippery or uneven, pebble-strewn surfaces. Every triathlete trains by swimming, biking and running prior to entering a triathlon, but few devote much if any time practicing the art of transitions. Again, these facts increase the stress levels of participants in this sport as they enter T1 and T2, and contribute to significant time losses that could and should be avoided.

There have been attempts to design shoes to reduce the amount of time spent in a transition area. For example, US Pub. No.: US 2012/0023783 A1 is a design for a cycling shoe that enables a faster entry of the triathlete's feet. However, this design pertains to the T1 zone, the swim to bike transition zone. Significantly, it does not eliminate the need to bend and use hands for fastening. It is comprised of a ratchet cinch tensioning device that is wholly inapplicable to a lightweight (racing flat) running shoe.

Another attempt is disclosed in US Pub. No.: US 2008/0066344 A1, which is a design related to the T2 zone that provides a laceless closure device for a running shoe. It is comprised of an interlaced strap designed for rapid adjustments in multiple planes of movement. The closure device comprises a strap that connects one end of the shoe upper and a plurality of ring means that require threading of the strap through the ring(s) by pulling upward upon the fastening member.

Critically, such prior art designs have not addressed the specific problems associated with the T2 transition, for example, elimination of the time-consuming and risk-related elements of having to bend, kneel or sit in order to enter and secure the feet in the running shoes.

SUMMARY OF THE INVENTION

It is an objective of the present disclosure to eliminate the foregoing problems associated with the T2 transition.

One risk factor obviated by the unique design of the running shoe disclosed herein is that of cramping in the calves, quadriceps, hamstrings or back muscles. These occurrences are common after having engaged in the preceding extreme exertions of swimming and cycling prior to entering the T2 zone. Therefore, eliminating the need to bend during the process of transitioning to running shoes for the third and final triathlon segment is highly desirable.

More specifically, the disclosure relates to a running shoe with a closure system that enables a participant in a multisport event (e.g., triathlon or duathlon) to complete a transition from one phase (i.e., the bike segment) to another (i.e., the running segment) in the fastest possible manner. The running shoe eliminates the time delay normally incurred in the process of devoting 100 percent of attention to the act of foot insertion, that is, bending over to insert and adjust both feet into running shoes manually. The running shoe also eliminates the customary step of bending over to touch the shoe area, and adjusting and otherwise devoting energy and precious time to securing the shoe fastening system. The running shoe facilitates the insertion of both feet during, not after, the performance of the two essential transition activities, specifically securing the bicycle to a post and removing the bicycle helmet. The running shoe is thus unique in converting what has always been at least a three-step process in the biking to running so-called "T2 transition" into a time-saving two-step process by using a reclining and/or pivottable heel design and two related closure elements, none of which requires hand contact with the shoe area to secure the foot in the shoe.

As one advantage, the running shoe enables rapid, hands-free and secure entry of the feet into running shoes during the second of two transition zones. The detailed description of how this is achieved is described below.

As another advantage, the hands-free shoe entry system disclosed herein is expressly designed to save critical race time, for example, as few as five seconds for practiced professional triathletes, to a minute or more for amateur, age group contestants not experienced or adept at the movement skills essential for fast equipment changes in the transition areas of this and other multisports.

The running shoe directly addresses the challenges and frustrations of the T2 transition. One key feature is the elimination of the need for the runner to bend over (or kneel or sit or balance while raising one leg in a near ballet-worthy pose) to secure the shoes using the hands to position and complete this essential function during the bike to run transition in T2. This time-saving, no bend required advance is accomplished by converting the minimally required, prior art three-step process of the T2 transition into a two-step process. By so doing, the difficulty of having to bend (or sit, kneel or stand balancing on one leg) in order to insert his/her feet into the running shoes is wholly avoided. Most importantly, the running shoe eliminates additional time losses and discomforts associated with adjustments to tighten or otherwise adjust the fit of the running shoes preparatory to departing the T2 transition area for the run segment of the triathlon.

The T2 transition shoe of the present disclosure advantageously facilitates quick and uninterrupted entry of the runner's foot therein followed by quick capture of the foot into a desired running position, without any need for the runner to bend over and touch the shoe for entry or fit. The shoe is usable for any sporting event but is particularly suited for the triathlon T2 as well as other transition stages in similar multisport contests where a swim (e.g., aquathon and aquabike) or bike (e.g., duathlon) precedes a run segment. In all phases of multisport events like triathlon (i.e., the swim segment, the T1 transition segment, bike segment, T2 transition segment, and run segment), time is of the essence. The minutes and seconds spent performing activities in one segment are as consequential as time spent in any other, no more or no less. Because of the ease and rapidity of entry and fit of the running shoe described herein, seconds to minutes are saved in the triathlete's total competition time. This occurs because the competitor does not have to separately perform the insertion of his/her feet into the running shoes after securing the bike and removing the helmet—the insertion of the feet occurs simultaneously with the performance of these two functions. As a consequence, the time required to perform three functions is reduced by more than a third.

Under normal circumstances without the novel design described herein, at least three steps are required in T2 to enter and secure the competitor's feet in running shoes: 1) insertion of the feet into the shoes; 2) adjusting the fit to relieve a bent heel top, a jammed shoe tongue, a bunched up shoe liner or other discomfort resulting from the hurried insertion of the feet; and 3) using the hands to pull up on the locking lace system that is commonly used as a time-saving alternative to traditional shoe laces. The three steps noted above usually require three to five times more seconds than the first two steps (i.e., racking the bike and removing the helmet from the head) combined. In summary, the third step that the running shoes of the present disclosure eliminates is a giant time-saver in T2 relative to the time cost of the existing three (or more) steps essential to completing all that has to be done in T2 to get on with and to commence with the run segment of the race. Further, besides the time saving, the running shoes also avoid the oftentimes risky task of bending to secure shoes, a movement that invites cramping after the preceding exertions.

In an exemplary embodiment, the running shoes includes a reclining cup-like heel that is pivotally connected to the shoe sole so that the runner can easily place a foot directly into the shoe without using hands to touch the shoe. The pivotally connected heel cup can then be brought forward to contact the back of the runner's heel. The heel cup is then closed to connect with the remainder of the shoe without the use of the runner's hands. The novel shoe design can also be utilized for time saving purposes in duathlons (a related sport that consists of a run/bike/run—no swim) and other multi-sport events. Further, nothing prevents the use of the novel shoe design for any purpose used for sport or comfort shoes.

The running shoe allows for the elimination of the former third step in T2 by eliminating the need for a separate and discrete shoe fitting step. Advantageously, the running shoe allows for quick and easy entry performed simultaneously with bike racking and helmet removal, which is facilitated by three simple, continuous movements performed with each foot on the other foot after the athlete has secured his feet in the shoes. For example, the insertions of the feet into the running shoes and the three continuous adjustments performed using the opposite foot for each shoe can be described as a two-step process: upon reaching the assigned post or other station fixture (e.g., a special stand) designated as the place where the bike must be secured (step one in our two-step transition), the athlete places the bike in an approved manner while at the same time stepping into the running shoes, which have been strategically placed before the race so as to facilitate this process. He/she then unfastens the helmet strap and removes the helmet while simultaneously using each foot to press against the back and then both sides of each shoe. These movements secure the straps that extend from the heel forward on both sides of the running shoes. This foot action sequence might transpire as follows: with both feet inside the shoes, the right foot is pressed against the heel and both sides of the left foot; the same pressing actions are repeated using the left foot pressed against the heel and both sides of the right foot. (Which foot is secured in which order is of no consequence—the sequence is a matter of personal preference.) These continuous, practiced foot actions raise the heels of the running shoes and bring the Velcro-like strap fasteners of the heels into secure contact with the forefront of both shoes.

While the athletes with shoes designed in accordance to this disclosure are running for the exit to begin the final event segment, his/her competitors are only getting started with entry attempts to get into their running shoes and adjust and tighten their running shoes. They face the non-inconsequential challenge of getting into, adjusting and securing their running shoes—which for most will involve considerable bending or leg lifting or, more likely for all but skilled professionals, kneeling or even sitting to perform the third-step function that the running shoe of the present disclosure has entirely eliminated. As noted, these actions might incur cramping for some athletes who must bend to secure their shoes with hand actions.

We will now describe in more detail the novel design.

In a preferred embodiment, the heel of the shoe is pivotally secured in a downward direction to the back end of the sole at any angle that does not impede the entry of the runner's foot (e.g. 30 to 50 degrees). A Velcro-like strap is attached to and extended out from each side of the pivotally secured heel. A Velcro-like target strip is placed on each side of the shoe opposite each Velcro-like strap. When the triathlete arrives at the assigned rack where the bike is to be placed, he/she inserts each foot into the running shoes, one at a time while racking the bike. The athlete does this by sliding each foot into the shoe so that the toes touch the front inside of the shoe. The athlete then takes the other foot, as noted above, and presses inwardly on each heel and against the outwardly extended Velcro-like straps. Thus, the heel firmly attaches to and locks against the Velcro-like target strip or patch located on the same side of the shoe. This process is then repeated on the other side of the shoe. With that foot secured, the athlete then repeats this very same routine in full on the shoe for the other foot. While performing this brief and practiced foot movement that secures the heel, the athlete can also be unfastening and removing his helmet, which is placed on the down bars of the bicycle. When both feet are locked and secured, the triathlete exits his station and begins the run-out to the T2 exit gate.

In a second embodiment, the Velcro-like straps that extend out from each side of the shoe, may have a spring-biased wire support inserted in them to further bend the Velcro-like straps away from the Velcro-like target strips or patches prior to desired closure to prevent accidental contact in an unwanted position before the foot is thoroughly inserted in the open shoe. This embodiment can eliminate even the very few seconds of alternate foot movements described above for closing and securing the side straps of the heels to the shoes.

In a further embodiment, a ground anchor can be used to secure the shoe at the front. This stabilizer platform for the running shoes prevents forward or side sliding when the feet are rapidly inserted upon the athlete's arrival at the bike rack in T2. The separate but well-anchored platform thereby prevents slippage during the transition process. This is of particular benefit when the transition area is muddy or otherwise slippery. In the world of multisports, contested in adverse as well as ideal weather conditions, rain often renders a dirt-surfaced transition area an unstable, possibly treacherous challenge. The underside of the ground anchor can be spiked for dirt or mud surfaces, or an adhesive agent can be secured to its undersurface as the ground anchor when the transition areas are concrete or composed of other hard, but slippery surfaces.

There may be other equivalent locking mechanisms that will be readily apparent to those skilled in the art that could be readily substituted within the scope of this disclosure.

DETAILED DESCRIPTION

Figure 1:
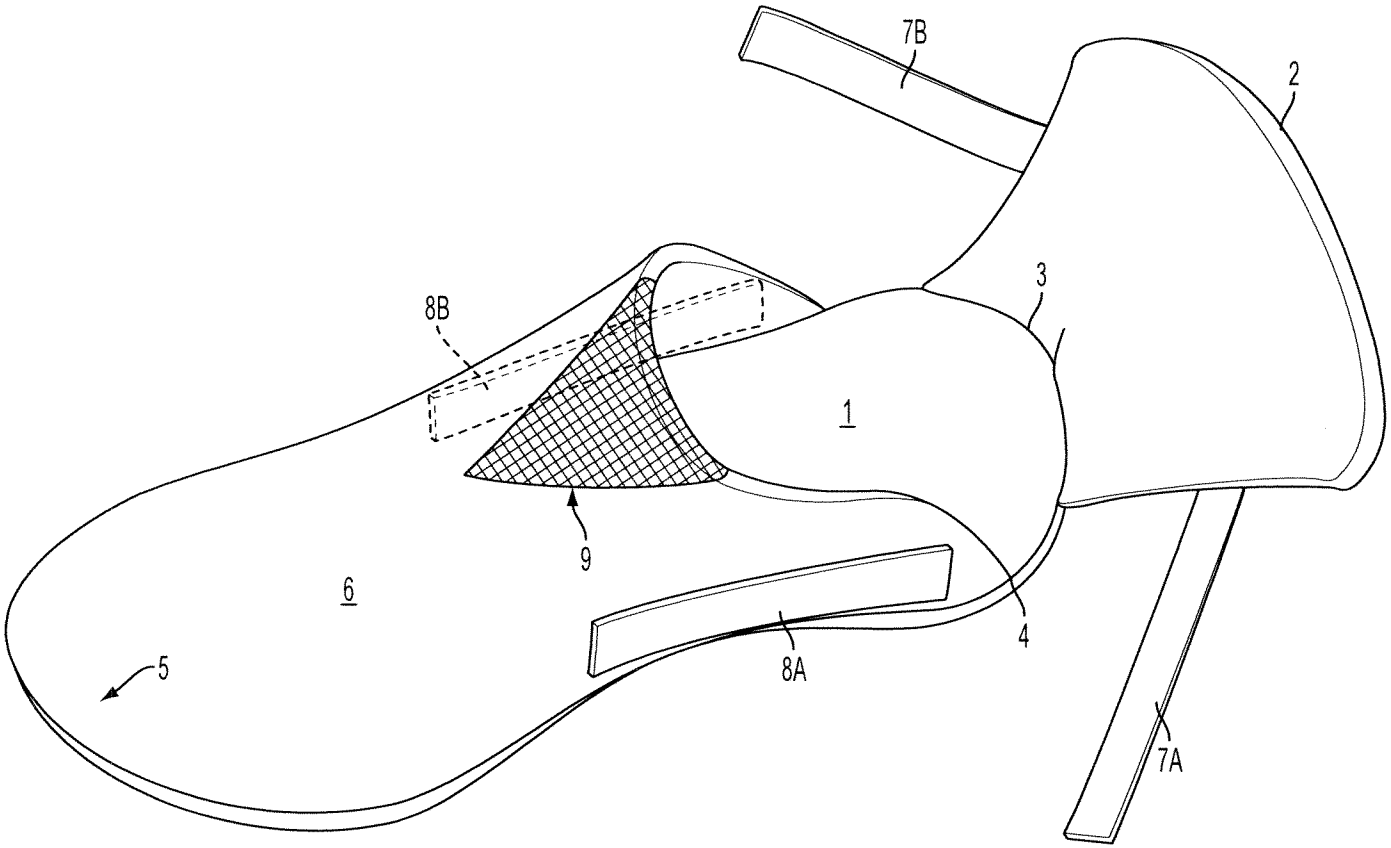
FIG. 1 is an exemplary perspective view diagram of a running shoe with its heel section tilted back from its sole and in an open position.

Several exemplary embodiments of the running shoes of the present disclosure are described herein. However, the invention should not be construed as being limited thereto. Nor should the use of the terms "comprises" or "comprising" with respect to certain features or elements of the running shoes disclosed herein be construed to preclude the presence of other features or elements.

As previously noted, the running shoes of the present disclosure significantly shorten the T2 transition time by reducing it from 3 stages to 2 stages. Specifically, the need for the athlete to use hands to hold, position and secure the feet into the shoes is eliminated. By eliminating these activities and the body positions required to enable such actions, the athlete diminishes the chances of suffering leg or other lower body cramps caused by the prior art 3 step T2 transition.

Historically, the pressure to promote transition area efficiencies in order to reduce the stress and especially the time that both transition stages entail has inspired several design ideas, including gear modifications. While the present disclosure herein expressed pertains to T2 in triathlons, note should be made of material innovations in T1, the first transition wherein the triathlete having completed the swimming phase must efficiently dispense with gear utilized for the swim (e.g., goggles, cap, wetsuit, ear plugs) in order to most expeditiously access the bike and all equipment essential to the biking segment of that race that commences upon exiting the T1 zone. We note, for example, that this phase has been addressed by others with some success. As noted previously, Pub. No.: US 2012/0023783 A1 WO2010048203 pertains to T1, specifically a cycling shoe design used by the athlete to speed the swim to bike transition. This bike shoe design does not eliminate the need to bend and use hands for fastening, as the ratchet cinch tensioning device utilized with a reclined heel must be turned several cycles to obtain a shoe fit that is comfortable and firm. The attachments attendant upon this design are unsuited for a lightweight (racing flat) running shoe.

The present disclosure specifically addresses the need to reduce the crucial T2 transition time between the bicycle and running phases in triathlons and other multisports with a running component (e.g., duathlons). The T2 segment of triathlon has, for the three decades of the sport's history, presented competitors with a challenge of how to most effectively coordinate the required steps, in what order and with what kinds of maximally efficient timing for speed and safety. After many attempts at advancing the state of the transition art and science, the bike to run or T2 process/transition has become a choreographed three-step practiced movement for the best triathletes in the world, namely, the professional class and many of the most accomplished amateurs, known as age group competitors. The latter are by far the majority of participants in the sport of triathlon, comprising as much as 99.9 percent of participants. However, both professionals and age groupers will welcome the running shoe disclosed herein that converts a three-step T2 experience into a two-step, time-saving advantage.

The most awkward, time-consuming and injury-threatening element of the T2 endeavor has always attended the movements required to remove bike shoes and put on running shoes. (Some more experienced triathletes leave their bike shoes mounted on the bike pedals. They do this before dismounting as they approach the bike dismount line.) Even such skilled, experienced competitors must deal with the challenge of inserting their bare feet quickly into running shoes, with the bending and other contortions required to affix the running shoes securely and comfortably. This has, prior to the running shoes disclosed herein, required the use of the runner's hands to position and secure the shoes on the athlete's feet as explained above and below. As described, the first step of the T2 transition requires the triathlete, after having dismounted the bike at the appointed place just outside the T2 area, to run to his/her specific area in the transition zone in order to affix the bike to the assigned rack. Placing the bike on that exact spot is the first step of the T2 transition process. The second step of the T2 process requires the athlete to remove the helmet.

If the bike shoes remain in the pedals of the bike, the third step, the most daunting by far in terms of skill and time demands, is to do all the movements necessary to put on running shoes. This means picking up the shoes, one at a time, inserting each foot, adjusting the shoes and securing the shoes. The latter entails tying laces, or pulling up on special ties or closing a flap across the forefront of the shoes. If the athlete chooses not to remove his/her feet from the bike shoes prior to dismounting from the bike and entering T2 on the run, then this action obviously will be the third step, with the running shoe actions just described being a fourth step. We estimate that a substantial number of triathletes prefer not to remove their bike shoes before T2, so the majority of triathletes have at least a four-step transition challenge in this zone. (Unless, of course, they have the running shoes disclosed herein, which for anyone so equipped renders the T2 zone procedure a two-step endeavor if bike shoes remain on the bike pedals, a three-step endeavor if not.)

Without the running shoes described herein, athletes who enter the T2 barefooted with bike shoes remaining on the bike pedals will face a minimal three-step series of steps. As noted, the running shoes of the present disclosure eliminate one significant step required by existing technologies.

Critically, by eliminating the usual third step in T2 (i.e., bending, kneeling or sitting in order to insert feet in running shoes and secure the shoes properly), the running shoes of the present disclosure all but eliminates the risk of cramping. No longer must the athlete bend over, sit or kneel for the purpose of reaching and fitting the running shoes. The hand-tightening of running shoes of the prior art, which are secured on the feet using shoestrings, pull strings or other equivalent mechanisms, such as a Velcro-like outer tongue or strap that fits across the top of the shoe, is also eliminated.

Furthermore, as has been emphasized above, the use of hands in T2 not only adds to the runner's overall race time; it also increases the risk of muscle cramps. Given the extreme exertions leading up to this stage of the race, the runner's lower body muscles have been stressed and fatigued by the grueling swim and bike segments.

With reference now to FIGS. 1 through 6 of the drawings, a running shoe apparatus according to exemplary embodiments of the present disclosure will be described. Thereafter, how the novel running shoe structure is used to eliminate the need to bend and touch the shoes and thereby speed the transition time while also minimizing risks of incurring muscle cramps will be described. It is noted that while the overall appearance of a typical commercial running shoe would likely include a more traditional aesthetic marketing appearance, the running shoe shown in these figures is instead exemplary of the novel constructional features.

Various commercially aesthetic versions of running shoes can use the embodiments and features of this disclosure.

Figure 2:
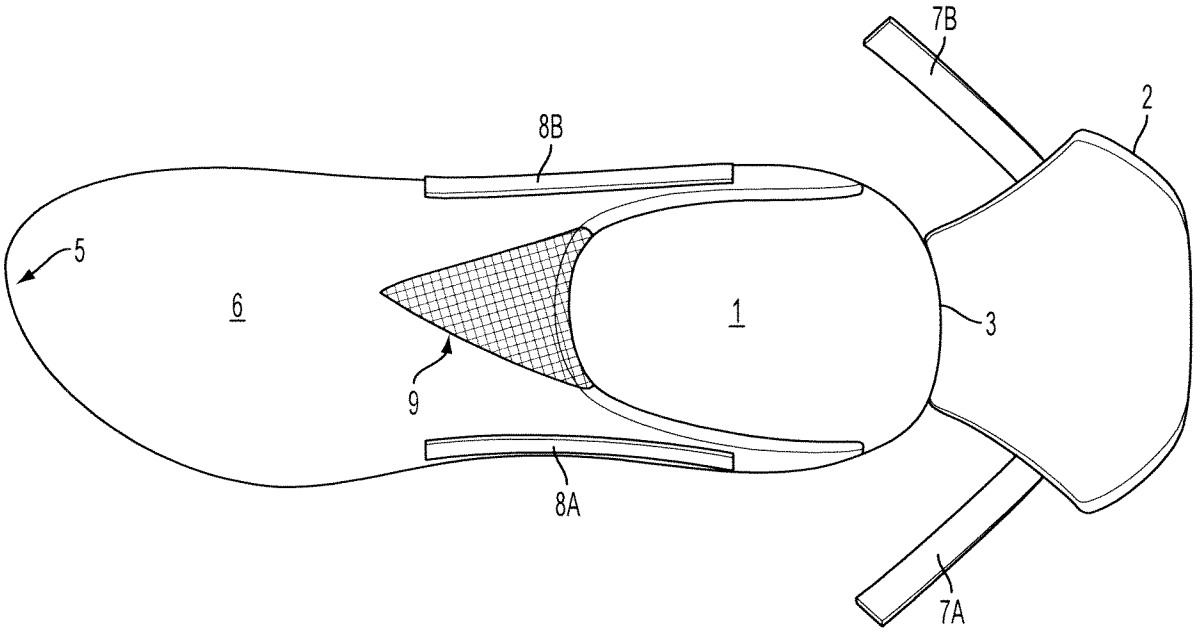
FIG. 2 is a top view diagram of the running shoe of FIG. 1 with its heel section in an open position.
Figure 3:
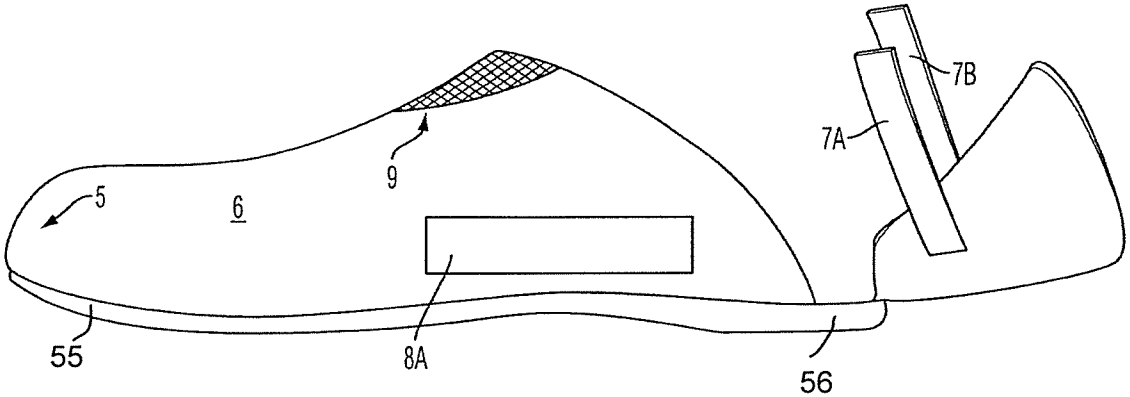
FIG. 3 is a side view diagram of the running shoe of FIG. 2 with its heel section in an open position.

An exemplary embodiment of the running shoe is illustrated in the perspective view in FIG. 1 and includes a sole 1 having a sole section 55 and a heel section 56, and heel cup section 2, that is affixed and hinged to pivot and be bent back at location 3 on the back area of sole 1. The running shoe further includes an upper or cover area 6 of the shoe, which is cut on each side at location 4 to permit the heel cup section 2 to be bent back to any desired angle that will permit quick and easy insertion of the runner's foot into the front cover upper area of the shoe as explained in more detail below. We have found that an approximately 30 to 50 degree angle range works best and provides the necessary dimensions for foot placement from a standing position. FIG. 2 is a top view looking down on the running shoe structure and showing the heel cup section 2 in the bent back and pivoted position. FIG. 3 is a side view of FIG. 2 showing the heel cup section 2 bent back. When the running shoe structure has the heel cup section 2 bent back as shown in FIGS. 1, 2 and 3, the runner's foot can be fully inserted into the shoe so that the toes touch the shoe inside front surface 5 without having to hand touch or hand grip the shoe as explained in more detail below. The top cover 6 is shown in FIGS. 1, 2 and 3 may be of any conventional shoe design used for fastening using any existing methodology used with conventional running shoes. For purposes of illustration only, we have shown a mesh-like design 9.

Figure 4:
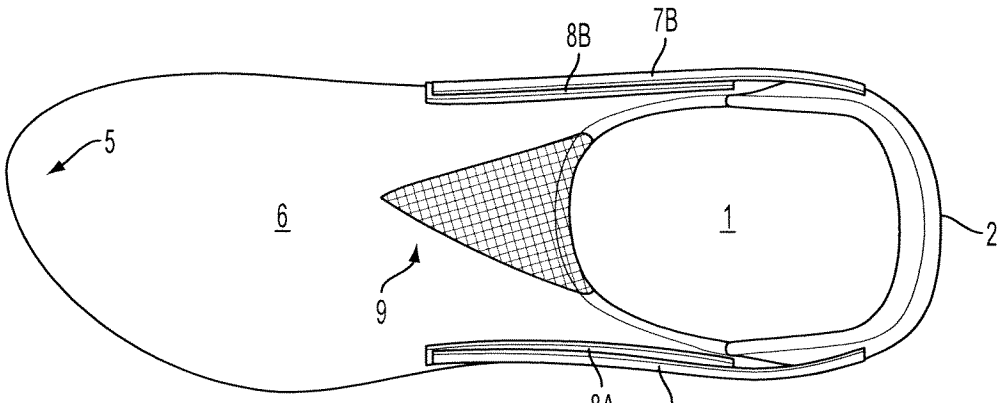
FIG. 4 is a top view diagram of the running shoe of FIG. 3 with its heel section in a closed position.
Figure 5:
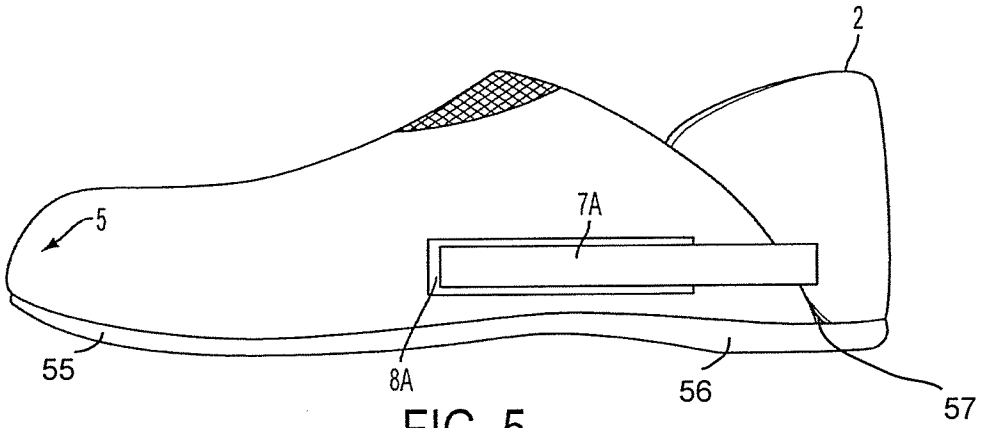
FIG. 5 is a side view of the running shoe of FIG. 4 with the heel section in a closed position.

The running shoe illustrated in FIGS. 1, 2 and 3 also includes outwardly extending hook/hole material such as Velcro-like straps 7A and 7B, which are secured to the heel boot cup areas by any traditional securing means such as, but not limited to, sewing, stitching, riveting or gluing. The running shoe also includes hook/hole or Velcro-like target patches 8A and 8B secured to the sides of the shoe again by any conventional attaching or securing means such as, but not limited to, sewing, stitching, riveting or gluing. The Velcro-like target patches 8A and 8B are positioned to receive and secure the Velcro-like straps 7A and 7B when the shoe is closed to the desired position. FIGS. 4 and 5 illustrate the running shoe when the heel cup section 2 is closed at the back of the runner's heel. Specifically, FIG. 4 is a top view that illustrates that the Velcro-like straps 7A and 7B have been secured respectively to the Velcro-like target patches 8A and 8B. FIG. 5 is a side view of FIG. 4 showing Velcro-like strap 7A secured to Velcro-like target strip or patch 7B. As shown in FIG. 5, there is a gap 57 between the heel cup section 2 and the cover area 6 when the heel cup section 2 is in the closed position.

Figure 6:
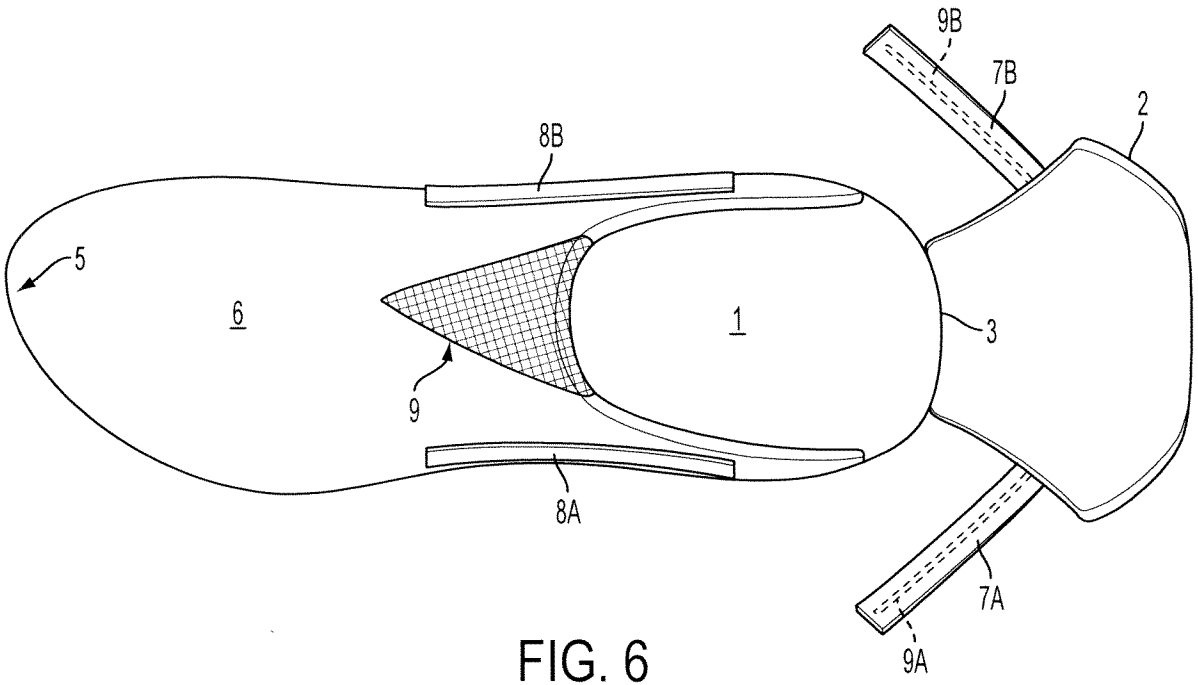
FIG. 6 is an exemplary top view of a second embodiment of the running shoe with the heel section in an open position and with spring biased wires in the outwardly extending straps.

Turning to another embodiment, FIG. 6 shows spring biased wires 9A and 9B inserted and secured inside Velcro-like straps 7A and 7B respectively to stiffen and bend the straps outwardly and further away from the Velcro-like target patches 8A and 8B which they will eventually be moved to make contact with. The addition of the spring biased wires or equivalent provides additional assurance that the Velcro-like straps will not accidentally touch the wrong location spot on the nearby Velcro-like target patches. This embodiment prevents closure at an undesired location spot. While the running shoes of the first embodiment as described above in FIGS. 1 to 5 does not require the addition of these spring biased wires or similar additional support in the Velcro-like straps, the addition thereof adds further confidence and insurance against premature, accidental sticking before full closure. In short, this embodiment provides the athlete with assurance that the Velcro-like straps will not accidentally collapse, bend or otherwise flap against the Velcro-like target patch.

The use of the running shoe having these additional spring biased wires or equivalents is exactly the same as described above for the shoes shown in FIGS. 1 to 5.

Figure 7:
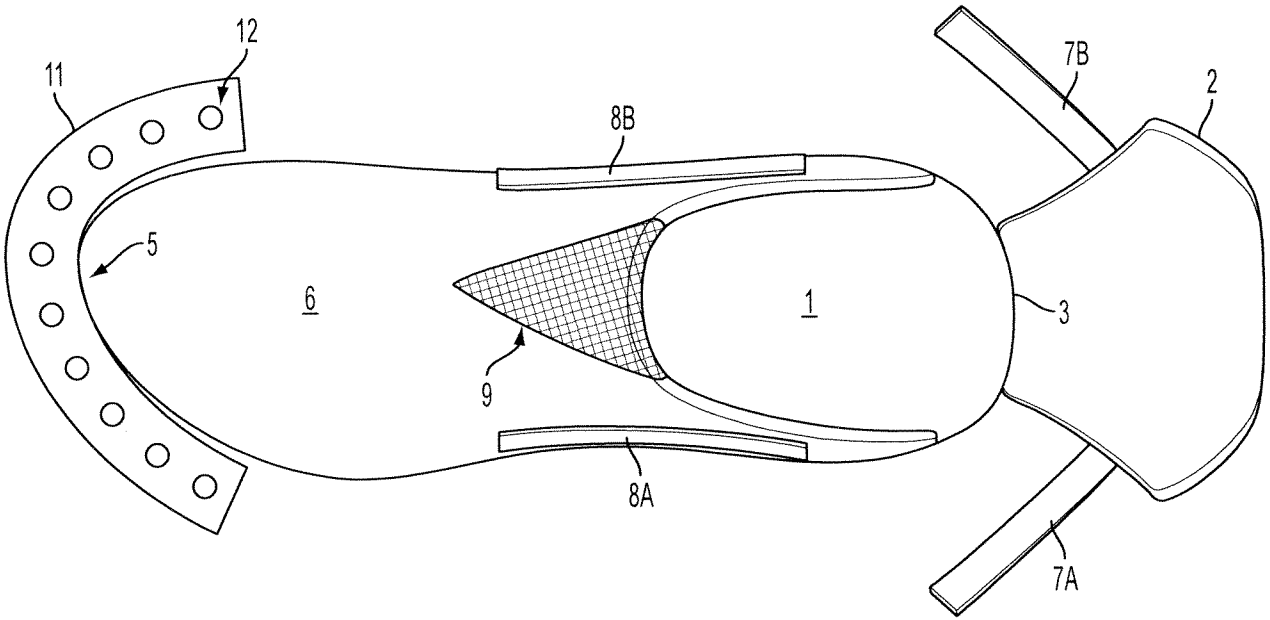
FIG. 7 is an exemplary top view of a device that can be used for use on wet or slippery surfaces, or as otherwise desired, to provide a ground anchor for the runner's toes during insertion into the shoe.
Figure 8:
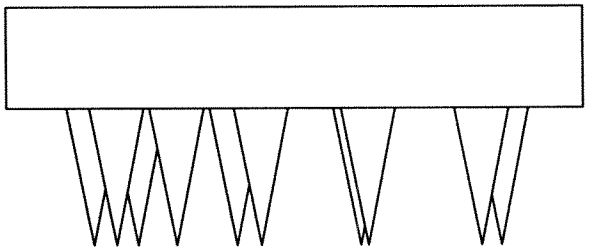
FIG. 8 is a top view of the anchor shown in FIG. 7.

Yet another embodiment is shown in FIGS. 7 and 8. There, in FIG. 7, a shoe anchor 11 is shown looking up at its bottom area. The anchor itself may be used to aid the runner in entry and securement of the runner's foot as shown in FIG. 7, especially where the ground surface is slippery due to rain, snow, ice or other factors contributing to a slippery surface of the transition area. Generally, as shown in FIG. 7, the shoe anchor 11 is shaped to accept the shape of the outer surface of the front toe area of the running shoe, and is of a width that allows for full placement against it of the front area of the triathlete's shoe when the feet placed into the shoes are extended to the full forward position. However, the horseshoe-like shape shown is merely illustrative of the general idea of an anchor suitable to hold the shoe in place as the athlete inserts his/her foot into the shoe and presses forward. Thus, any shape that achieves that result is within the spirit of the inventive concept of using an anchor where there is a slippery surface. It is noted, however, that even in situations involving slippery surfaces, the above embodiments of the running shoe shown in FIGS. 1 to 7, may still be used without the need of an anchor, but with the possibility of more difficulty and additional time to adjust to the slippery surface. Nevertheless, in those situations involving slippery surfaces, the anchor 11 can instead be placed and secured to hold steady so that the shoe may be pushed against it more easily as the foot enters the shoe.

The horseshoe-like shaped anchor base 11 can be made from any suitable plastic, such as, but not limited to, polyethylene or polypropylene, or from rubber or metal track shoe-like spikes 12, or equivalents thereof. These are located at many locations around the horseshoe like base 11. Exemplary equivalents are small construction nails, and baseball-like cleats of extended length. The length of the spikes, or equivalents, should be in the range of 1 to 4 inches, as the important design feature of the spikes and equivalents is to extend downwardly deep enough into the surface area to secure the anchor in even the muddiest surface.

The running shoes are shown in FIGS. 1 to 6 with heel cup-like bent back positions are seen with the anchor mechanism shown in FIGS. 7 and 8. This is the way in which the shoes and anchor mechanism will be positioned in the assigned transition area prior to the start of the race. At least two shoe anchors are inserted into the ground in secure positions. Each shoe is then placed against the shoe anchor as is shown in FIG. 7. The anchored running shoes are thus secured and are ready for hands free transition from the biking segment to the running segment as described above with respect to the running shoe embodiments shown in FIGS. 1 to 6.

In another embodiment of the running shoe, the shoe design includes a single Velcro-like patch to the outside of the standard flap that is usually affixed to the top of a running shoe heel. This flap is designed on a standard running shoe as an aid for the "grab and pull up" of the heel when putting on shoes. In accordance with this embodiment, the flap extends with the 45 degree or other desired degree angled upper heel prior to the arrival of the runner in the T2 zone. To assure that the closure system is not released prematurely, a target patch of a suitable size, for example, but not limited to, 1 inch by 1 inch, is added to the outside of this flap with adhering sticky surfaces on both sides. This patch attaches to the outside of the heel in order to adhere lightly, keeping the reclined angle in place. This single two-sided patch on the one-inch heel flap adheres to the exterior heel in a manner strong enough to keep the reclined heel in the desired position while also being amenable to easy release by the opposite foot once the runner has entered his foot into the shoe.

It is noted that modern lightweight running shoes are made using a combination of materials. The running shoes disclosed herein can be made of the same materials as currently available running shoes and do not require any materials not currently employed for the insole, midsole or outsole layers, or for the critical reclining heel segment or Velcro-like fastening linings of the disclosed embodiments. For example, a thin layer of artificial ethylene vinyl acetate (EVA) and/or a polyurethane used to encompass other material (e.g., a gel or liquid silicone, or polyurethane foam) would be suitable material elements of the heel, as well as other possible components in areas of the running shoe. Other synthetic elements may include, but are not limited to, artificial suede, a nylon weave, possibly with plastic slabs or boards to support the optimal heel configuration.

Although only a limited number of embodiments of this invention are described and disclosed above, one of ordinary skill in the art will readily recognize that there are variations and other embodiments within the scope of the appended claims. It is thus recognizable by those skilled in the art that various changes and modifications can be made to the transition running shoe described above, as well as the running shoe and anchor described above, without departing from the scope of the appended claims and their equivalents.

What is claimed is:

1. A running shoe, comprising:

a sole having a toe section and a heel section;

a material cover connected to an upper area of the sole to form a cavity for receiving the foot of a runner;

a heel cup section formed from a material that is different than a material the sole is formed from, the heel cup section being hinged to a back end of the heel section of the sole to permit the heel cup section to recline at an angle sufficient to allow the runner's foot to move smoothly into the shoe while the shoe remains in a substantially horizontal position; and a fastening system for securing the heel cup section in a closed position, the fastening system comprising a connecting strap outwardly extended from each side of side surfaces of the heel cup section, and a receiving strap connected to each side of the material cover in a side position that will contact the connecting strap so as to secure the heel cup section in the closed position, wherein a lowermost portion of the heel cup section has a width such that the lowermost portion of the heel cup section does not overlap with the material cover so as to form a gap between the lowermost portion of the heel cup section and the material cover when the heel cup section is in the closed position.

2. The running shoe of claim 1, further including spring bias wires connected to the connecting straps to secure the connecting straps away from the receiving straps when the heel cup section is in an open position.

3. The running shoe of claim 2, wherein the connecting straps and the receiving straps are Velcro or a Velcro-like material.

4. The running shoe of claim 1, wherein the connecting straps and the receiving straps are Velcro or a Velcro-like material.

5. A running shoe and anchor comprising:

the running shoe of claim 1;

an anchor made of a material formed to receive and secure an outer sole of the running shoe of claim 1; and spikes extending through the anchor material to permit insertion into a ground area wherein the anchor will receive and hold the runner's shoe of claim 1 for a desired time.

6. The running shoe anchor of claim 5, wherein the anchor is made of a suitable rubber, plastic or metal material.

7. The running shoe and anchor of claim 5 wherein the spikes are made of metal.

8. The running shoe and anchor of claim 5 wherein the spikes have a nail-like shape.

9. The running shoe and anchor of claim 5 wherein the spikes are made of the same material as the anchor.

10. A running shoe and anchor comprising:

the running shoe of claim 1;

an anchor made of a material formed to receive and secure an outer sole of the running shoe of claim 1; and an adhesive surface connected to an underside of the anchor for securing the anchor to a dry ground surface.

11. A running shoe comprising;

a sole having a heel section;

a heel cup section formed from a material that is different than a material the sole is formed from and which is pivotally hinged to a back end of the heel section of the sole, the heel cup section being pivotal between an open position and a closed position;

a cover section connected to the sole to form a cavity for receiving a foot of a runner;

securing straps secured to the heel cup section; and target strips secured to sides of the cover section, wherein the securing straps when connected with the target strips maintain the heel cup section in the closed position, and wherein a lowermost portion of the heel cup section has a width such that the lowermost portion of the heel cup section does not overlap with the cover section so as to form a gap between the lowermost portion of the heel cup section and the cover section when the heel cup section is in the closed position.

12. A running shoe, comprising:

a sole having a toe section and a heel section;

a material cover connected to an upper area of the sole to form a cavity for receiving the foot of a runner;

a heel cup section hinged to a back end of the heel section of the sole to permit the heel cup section to recline at an angle sufficient to allow the runner's foot to move smoothly into the shoe while the shoe remains in a substantially horizontal position;

a fastening system for securing the heel cup section in a closed position, the fastening system comprising a connecting strap outwardly extended from each side of side surfaces of the heel cup section, and a receiving strap connected to each side of the material cover in a side position that will contact the connecting strap so as to secure the heel cup section in the closed position; and spring bias wires directly connected to the connecting straps to secure the connecting straps away from the receiving strap when the heel cup section is in an open position.

* * * * *